US006041875A

United States Patent [19]

Rai et al.

[11] Patent Number: 6,041,875

[45] Date of Patent: Mar. 28, 2000

[54] NON-PLANAR INTERFACES FOR CUTTING ELEMENTS

[75] Inventors: Ghanshyam Rai, The Woodlands, Tex.; Ronald K. Eyre, Orem; Nathan R. Anderson, Pleasant Grove, both of Utah

[73] Assignee: Smith International, Inc., Houston, Tex.

[21] Appl. No.: 08/986,200

[22] Filed: Dec. 5, 1997

Related U.S. Application Data

[60] Provisional application No. 60/033,239, Dec. 6, 1996.

[51] Int. Cl.[7] ..... E21B 10/46

[52] U.S. Cl. ..... 175/432; 175/428; 175/426

[58] Field of Search ..... 175/432, 428, 175/426; 299/113

[56] References Cited

U.S. PATENT DOCUMENTS

| | | | |
|---|---|---|---|
| 3,745,623 | 7/1973 | Wentorf, Jr. et al. | 29/95 B |
| 4,109,737 | 8/1978 | Bovenkerk | 175/329 |
| 4,592,433 | 6/1986 | Dennis | 175/329 |
| 4,604,106 | 8/1986 | Hall et al. | 51/293 |
| 4,629,373 | 12/1986 | Hall | 407/118 |
| 4,764,434 | 8/1988 | Aronsson et al. | 428/565 |
| 4,784,023 | 11/1988 | Dennis | 76/108 |
| 4,861,350 | 8/1989 | Phaal et al. | 51/307 |
| 4,866,885 | 9/1989 | Dodsworth | 51/293 |
| 4,954,139 | 9/1990 | Cerutti | 51/293 |
| 4,959,929 | 10/1990 | Burnand et al. | 51/307 |
| 4,972,637 | 11/1990 | Dyer | 51/295 |
| 4,984,642 | 1/1991 | Renard et al. | 175/329 |
| 4,997,049 | 3/1991 | Tank et al. | 175/410 |
| 5,007,207 | 4/1991 | Phaal | 51/204 |
| 5,011,515 | 4/1991 | Frushour | 51/307 |
| 5,037,451 | 8/1991 | Burnand et al. | 51/293 |
| 5,120,327 | 6/1992 | Dennis | 51/293 |
| 5,135,061 | 8/1992 | Newton, Jr. | 175/428 |
| 5,217,081 | 6/1993 | Waldenström et al. | 175/420.2 |
| 5,253,939 | 10/1993 | Hall | 384/303 |
| 5,335,738 | 8/1994 | Waldenstrom et al. | 175/420.2 |
| 5,351,772 | 10/1994 | Smith | 175/428 |
| 5,355,969 | 10/1994 | Hardy et al. | 175/432 |
| 5,379,854 | 1/1995 | Dennis | 175/434 |
| 5,435,403 | 7/1995 | Tibbitts | 175/432 |
| 5,449,048 | 9/1995 | Thigpen et al. | 175/430 |
| 5,469,927 | 11/1995 | Griffin | 175/432 |
| 5,477,034 | 12/1995 | Dennis | 219/615 |
| 5,484,330 | 1/1996 | Flood et al. | 451/540 |
| 5,484,468 | 1/1996 | Ostlund et al. | 75/236 |
| 5,486,137 | 1/1996 | Flood et al. | 451/540 |
| 5,492,188 | 2/1996 | Smith et al. | 175/432 |
| 5,494,477 | 2/1996 | Flood et al. | 451/540 |
| 5,499,688 | 3/1996 | Dennis | 175/426 |
| 5,544,713 | 8/1996 | Dennis | 175/434 |
| 5,564,511 | 10/1996 | Frushour | 175/431 |
| 5,566,779 | 10/1996 | Dennis | 175/426 |
| 5,590,728 | 1/1997 | Matthias et al. | 175/432 |
| 5,598,750 | 2/1997 | Griffin et al. | 76/108.2 |
| 5,605,199 | 2/1997 | Newton | 175/432 |
| 5,611,649 | 3/1997 | Matthias | 407/118 |
| 5,617,928 | 4/1997 | Matthias et al. | 175/432 |
| 5,622,233 | 4/1997 | Griffin | 175/432 |
| 5,645,617 | 7/1997 | Frushour | 51/309 |
| 5,655,612 | 8/1997 | Grimes et al. | 175/401 |
| 5,662,720 | 9/1997 | O'Tighearnaigh | 51/295 |
| 5,669,271 | 9/1997 | Griffin et al. | 76/108.2 |
| 5,871,060 | 2/1999 | Jensen et al. | 175/420.2 |

*Primary Examiner*—David Bagnell
*Assistant Examiner*—John Kreck
*Attorney, Agent, or Firm*—Christie, Parker & Hale, LLP

[57] ABSTRACT

This invention is directed to cutting elements having an ultra hard cutting layer such as polycrystalline diamond or polycrystalline cubic boron nitride bonded on a cemented carbide substrate. The interface between the substrate and the cutting layer of each such cutting element is non-planar. The non-planar interface is designed to enhance the operating life of the cutting element by reducing chipping, spalling, partial fracturing, cracking and/or exfoliation of the ultra hard cutting layer, and by reducing the risk of delamination of the cutting layer from the substrate.

13 Claims, 9 Drawing Sheets

NON-PLANAR INTERFACES FOR CUTTING ELEMENTS

CROSS-REFERENCE TO RELATED APPLICATION

This application claims priority pursuant to 35 U.S.C. § 119(e) and 37 CFR § 1.78(a)(4), to provisional Application No. 60/033,239, filed on Dec. 6, 1996.

BACKGROUND OF THE INVENTION

This invention relates to cutting elements and more specifically to cutters having a non-planar interface between their substrate and cutting layer, e.g. cutting table.

For descriptive purposes the present invention is described in terms of a cutter. A cutter, shown in FIG. 30 typically has a cylindrical cemented carbide substrate body 100 having a longitudinal axis 102. A diamond cutting table (i.e., diamond layer) 34 is bonded onto the substrate. The cutting table has a planar, typically horizontal upper surface 103. As it would become apparent to one skilled in the art, the invention described herein could easily be applied to other types of cutting elements such as enhanced cutters, end mills, drills and the like. Moreover, "diamond," "diamond surface" and "diamond table" are used interchangeably herein to describe the cutter cutting table.

Common problems that plague cutting elements and specifically cutters having an ultra hard diamond-like cutting table such as polycrystalline diamond (PCD) or polycrystalline cubic boron nitride (PCBN) bonded on a cemented carbide substrate are chipping, spalling, partial fracturing, cracking or exfoliation of the cutting table. These problems result in the early failure of the cutting table and thus, in a shorter operating life for the cutter.

It has been thought that the problems, i.e., chipping, spalling, partial fracturing, cracking, and exfoliation of the diamond layer are caused by the difference in the coefficient of thermal expansion between the diamond and the substrate. Specifically, the problems are thought to be caused by the abrupt shift in the coefficient of thermal expansion on the interface 104 between the substrate and the diamond. This abrupt shift causes the build-up of residual stresses on the cutting layer.

The cemented carbide substrate has a higher coefficient of thermal expansion than the diamond. During sintering, both the cemented carbide body and diamond layer are heated to elevated temperatures forming a bond between the diamond layer and the cemented carbide substrate. As the diamond layer and substrate cool down, the substrate shrinks more than the diamond because of its higher coefficient of thermal expansion. Consequently, stresses referred to as thermally induced stresses are formed at the interface between the diamond and the body.

Moreover, residual stresses are formed on the diamond layer from decompression after sintering. The high pressure applied during the sintering process causes the carbide to compress more than the diamond layer. After the diamond is sintered onto the carbide and the pressure is removed, the carbide tries to expand more than the diamond imposing a tensile residual stress on the diamond layer.

In an attempt to overcome these problems, many have turned to use of non-planar interfaces between the substrate and the cutting layer. The belief being, that a non-planar interface allows for a more gradual shift in the coefficient of thermal expansion from the substrate to the diamond table, thus, reducing the magnitude of the residual stresses on the diamond. Similarly, it is believed that the non-planar interface allow for a more gradual shift in the compression from the diamond layer to the carbide substrate. However, these non-planar interfaces do not address all of the problems that plague cutters.

Another reason for cracking and also for the spalling, chipping and partial fracturing of the diamond cutting layer is the generation of peak (high magnitude) stresses generated on the diamond layer on the region at which the cutting layer makes contact with the earthen formation during cutting. Typically, the cutters are inserted into a drag bit at a rake angle. Consequently, the region of the cutter that makes contact with the earthen formation includes a portion of the diamond layer near to and including the diamond layer circumferential edge.

A yet further problem with current cutters is the delamination and/or exfoliation of the diamond layer from the substrate of the cutter resulting in the failure of the cutter. Delamination and/or exfoliation become more prominent as the thickness of the diamond layer increases.

Another disadvantage with some current cutters having non-planar interfaces, is that they must be installed in the drag bits in a certain orientation. For example, cutters which have a non-planar interface consisting of alternating ridges and grooves, must be positioned on the drag bit such that the alternating ridges and grooves are perpendicular to the earth formation 14 (FIG. 31). The rationale being that as the cutter wears, the diamond located in the grooves on the substrate will be available to assist in cutting. Consequently, the installation of such cutters on a drag bit at a specific orientation becomes time consuming thereby, increasing the cost of drilling operations.

Accordingly, there is a need for a cutter having a diamond table with improved cracking, chipping, fracturing, and exfoliating characteristics, and thereby an enhanced operating life which is not orientation dependent when inserted into a drag bit.

SUMMARY OF THE INVENTION

This invention is directed to cutting elements, having an ultra hard diamond-like cutting layers such as polycrystalline diamond (PCD) or polycrystalline cubic boron nitride (PCBN) bonded on a cemented carbide substrate wherein the interface between the substrate and the diamond-like cutting layer is non-planar. The non-planar interfaces which are the subject matter of the present invention, enhance the operating lives of such cutting elements by reducing chipping, spalling, partial fracturing, cracking or exfoliation of their diamond-like cutting layer, as well as reducing the risk of delamination of the diamond-like cutting layer from the substrate allowing for the use of a thicker diamond layer.

For illustrative purposes, these non-planar interfaces are described in relation to a cylindrical cutter. Moreover, these interfaces are described in terms of the geometry of the substrate surface that interfaces with the diamond-like cutting layer. Furthermore, for descriptive purposes, convex and concave surfaces are sometimes referred to herein as "curved" surfaces.

A first non-planar interface has circular irregularities. These circular irregularities are randomly arranged along concentric annular rows. A circular irregularity is also positioned at the center of the cutting end.

A second non-planar interface is formed by a set of parallel wiggly irregularities spanning the substrate surface.

A third non-planar interface is formed by a set concentric irregularities. Each of these concentric irregularities forms a square having rounded corners.

The irregularities described in the three aforementioned non-planar interfaces may be depressions or protrusion or the combination of depressions and protrusions on the substrate surface which interfaces with the cutting table. These depressions may be shallow, i.e., having a depth of at least 0.005 inch and typically not more than 0.03 inch, or they may be deep, i.e., having a depth of at least 0.005 inch but typically not greater than 0.15 inch. The protrusions have a height of at least 0.005 inch and typically not more than 0.03 inch. The depressions have a concave bottom while the protrusions have a convex upper surface. In addition, these irregularities may be formed on a convex or (i.e., dome-shaped), concave or on a tiered substrate surface. In other embodiments, the depressions have depths which increase with distance away from the center of the substrate with the depression nearest the substrate circumference being the deepest. Similarly, the protrusions may have a height that decreases with distance away from the center of the substrate.

A fourth non-planar interface is formed by two sets of grooves. The first set of grooves defines a set of concentric triangles. The second set of grooves defines a second set of concentric triangles which is superimposed on the first set of concentric triangles. The first set of triangles is oriented opposite the second, such that when the two sets are superimposed they form a set of concentric six-point stars.

A fifth non-planar interface is formed by two sets of linear parallel grooves. The first set of grooves intersects the second set of grooves.

The grooves of the fourth and fifth non-planar interfaces have a depth that is preferably at least 0.005 inch and typically is not more than 0.03 inch. The groove may have either a concave or a square bottom. The grooves typically have vertical sidewalls and a concave bottom. Moreover the depth of the grooves may be shallower at the center of the substrate and deeper at the circumferential edges of the substrate. Furthermore, these grooves may be formed on a convex, concave or on a tiered substrate surface.

The sixth interface has cylindrical protrusions. These protrusions are oriented in parallel lines. In a first embodiment, the bases of adjacent protrusions flare out forming bowled depressions. The protrusions have a height measured from the lowest point on the substrate surface on which they are formed that is preferably at least 0.005 inch and typically not more than 0.03 inch. These protrusions may also have a height which decreases with distance away from the center of the substrate. Moreover, these protrusions may be formed on a convex, concave or tiered substrate surface.

DETAILED DESCRIPTION

Figure 1:
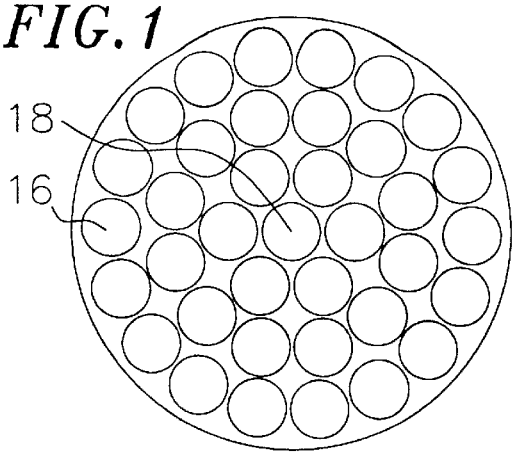
FIGS. 1–6 are top views of non-planar interfaces formed on the substrate of a cutter.

Testing by the applicants has revealed that the nature of the residual stresses generated by the difference in the coefficients of thermal expansion between the substrate and the diamond cutting table is compressive. Moreover, it was noticed that such residual stresses do not vary very much in any one direction. These compressive stresses tend to hinder, rather than promote cracking, chipping, fracturing or exfoliation. It is tensile stresses that would promote such problems. As such, it is believed that the abrupt shift in the coefficient of thermal expansion at the interface of the substrate and the diamond may not be the reason for the cracking, chipping, fracturing, spalling or exfoliation that plague cutters.

The ability of the diamond to resist chipping, i.e., its chipping resistance is increased with an increase in the diamond thickness. Applicants have theorized that chipping is a function of the material's ability to absorb energy, i.e., energy generated by impact. The thicker, or rather, the more voluminous the diamond table, the more energy it will be able to absorb and the greater chip resistance that it will have. On the other hand, as the volume (or thickness) of the diamond table increases, the more likely that the diamond table will delaminate from the substrate or exfoliate.

Another factor that effects the chipping resistance of the diamond is the diamond grain size. Chipping resistance increases with increasing grain size. Similarly, fracture toughness increases with increasing grain size. However, the abrasion resistance and strength of the diamond decreases with increasing grain size. For example, it is known that cutting layers having a finer grade of diamond (e.g., diamond having a grain size of less than $15\mu$) tend to have a higher abrasion resistance and strength but lack in fracture toughness. Coarser diamond surfaces (e.g., diamond having a grain size greater than $45\mu$ and up to $150\mu$) seem to have good fracture toughness but lack in abrasion resistance and strength. Medium grades of diamond surfaces (e.g., diamond having a grain size from 20μ up to 45μ) appear to provide an optimum balance between abrasion resistance and fracture toughness.

The non-planar interfaces which are the subject matter of the present invention, and shown in FIGS. 1–6, increase the operating life of a cutting element such as a cutter by providing an optimum balance between the chip and impact resistance, fracture toughness, abrasion resistance and crack growth resistance of the cutter's diamond cutting table. At the same time these non-planar interfaces allow for use of thicker diamond tables without increasing the risk of delamination.

To enhance the operating life of a cutter, the thickness of the diamond layer was increased so as to increase the chipping and impact resistance, as well as, the fracture toughness of the diamond layer. To overcome the delamination problems associated with a thicker diamond surface, an non-planar interface, as shown in either of FIGS. 1–6 between the diamond surface and the substrate is used. These non-planar interfaces provide for a larger bonding area between the diamond and the substrate so as to reduce the stress levels at the interface, thereby reducing the risk of delamination. A diamond table having a thickness of at least 1000μ but no greater than 4000μ is preferred.

Furthermore, by using a significantly thicker diamond table (i.e., a diamond table having a thickness of at least 1000μ), diamond of decreased grain size may be employed having an increased abrasion resistance. The decrease in chipping and impact resistance, as well as, as in fracture toughness due to the decrease in grain size is overcome by the increase in the thickness (and volume) of the diamond table. It is preferred that medium grain size diamond having a grain size in the range of 20μ to 45μ is used.

Moreover, with the present invention, the volume distribution over the cutting element can be tailored to provide for an optimum use of the diamond. With cutters only a portion of the diamond surface near and including the edge of the cutter is typically used during cutting. In such cutters, an interface allowing for more diamond volume proximate the edge of the cutter is preferred.

In addition, the interfaces shown in FIGS. 1–6 are orientation neutral. The depressions and/or protrusions are not oriented only in a single direction. By being orientation neutral, the cutter can be inserted into the bit without concern as to the orientation of the depressions and/or protrusions in relation to the earth formation to be cut.

These interfaces are described herein in terms of the geometry of the substrate surface that interfaces with the diamond table. The geometry of the diamond table surface interfacing with the substrate is not described since it mates perfectly with the substrate interfacing surface whose geometry is described. In other words, the diamond table surface interfacing with the substrate has a geometry complementary to the geometry of the substrate surface with which it interfaces.

A first non-planar interface as shown in FIG. 1 has circular irregularities on an end of a substrate which interfaces with the cutting table. These circular irregularities are randomly arranged along annular concentric rows. A circular irregularity 18 is also positioned at the center of the cutting end.

Figure 7:
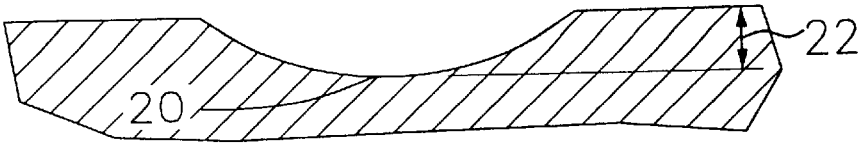
FIGS. 7–13 are cross-sectional views of the various embodiments of the non-planar interface, shown in FIG. 1, formed between the substrate and the cutting table of a cutter.

In a first embodiment of the FIG. 1 interface, these irregularities are depressions 20 in the substrate (FIG. 7). These depressions are spherical sections which are typically smaller than a hemisphere. They have a concave cross-section. Their depth 22 is preferably at least 0.005 inch and typically not more than 0.03 inch.

Figure 8:
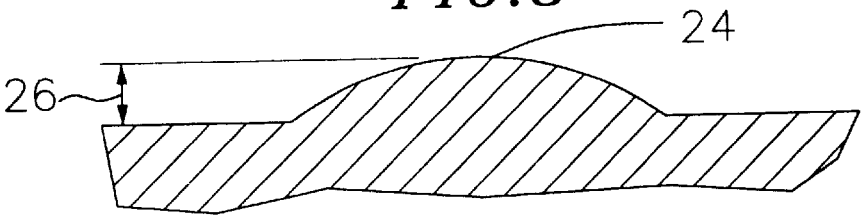

In a second embodiment of the FIG. 1 interface, the circular irregularities are protrusions 24 (FIG. 8) which are the mirror images of the depressions of the first embodiment. In other words, these protrusions are spherical sections which are smaller than a hemisphere and have a convex cross-section. Their height 26 is preferably at least 0.005 inch and typically not more than 0.03 inch.

Figure 9:
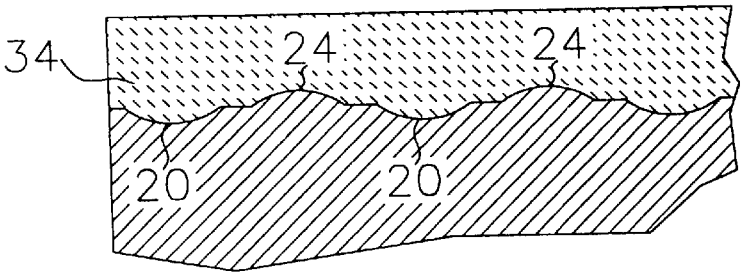

In a third embodiment of the FIG. 1 interface, the circular irregularities on the substrate are a combination of both the depressions of the first embodiment and the protrusions of the second embodiment (FIG. 9).

Figure 10:
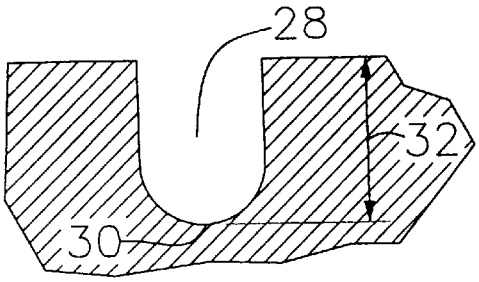

In a fourth embodiment of the FIG. 1 interface, the circular irregularities are cylindrical depressions 28 having a concave bottom surface 30 (FIG. 10). These depressions preferably have a depth 32 of at least 0.05 inch and typically of not more than 0.15 inch.

Figure 11:
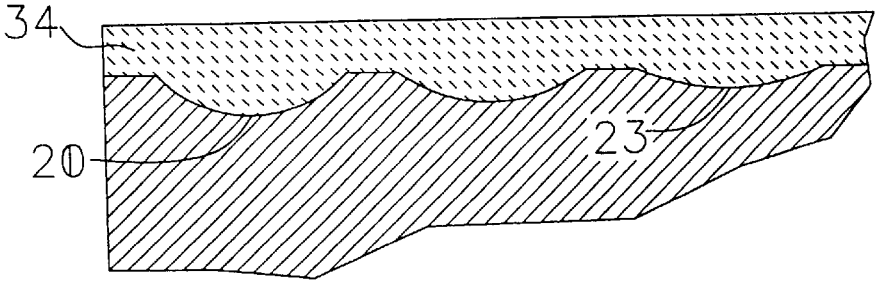
Figure 12:
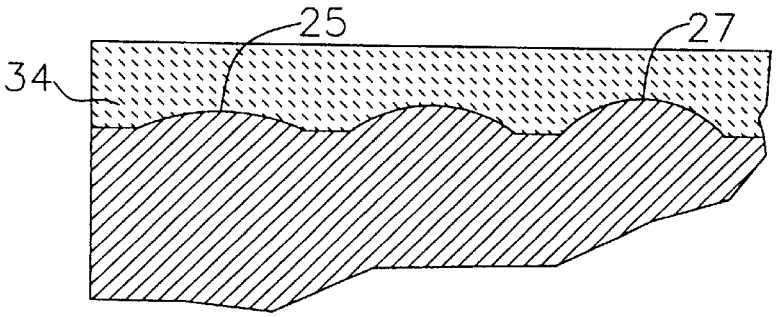

In a fifth embodiment of the FIG. 1 interface, the irregularities are depressions wherein the depressions 21 closer to the circumference of the cutter are deeper than the depression 23 closer to the center of the cutter (FIG. 11). In a sixth embodiment the irregularities are protrusions wherein the protrusions 25 near the center are higher than the protrusions 27 near the circumference of the cutter (FIG. 12). In this regard, the diamond volume differential increases from the center of the diamond table toward the diamond circumference providing for more diamond in the area of the cutting table most often used for cutting.

Figure 13:
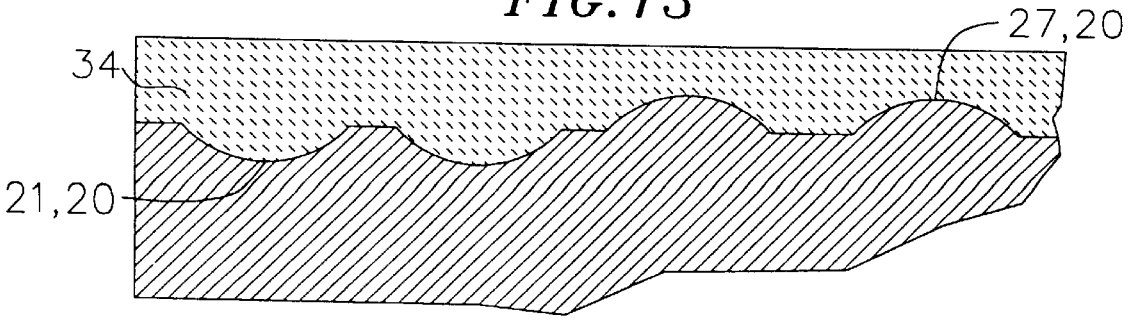

In a sixth embodiment of the FIG. 1 interface, the irregularities near the center are protrusions 20, 27 while the irregularities near the circumferential edges of the cutting elements are depressions 20, 21 (FIG. 13). This embodiment also provides for an increase in the volume differential of the diamond in a direction away from the center of the cutting element.

Figure 2:
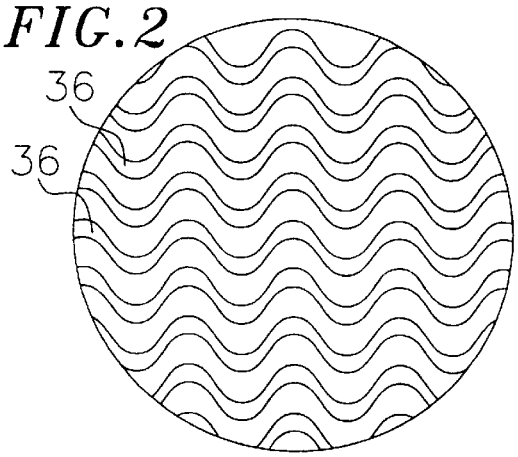
Figure 3:
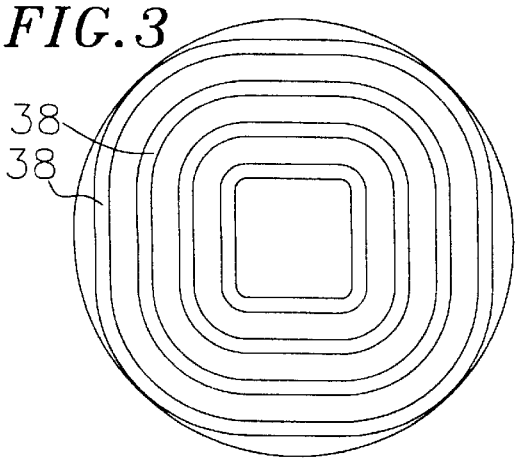
Figure 14:
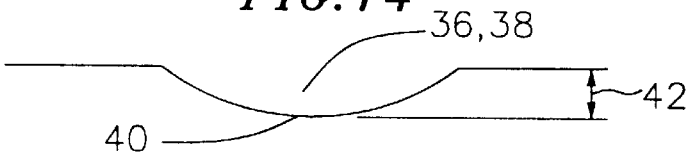
FIGS. 14–19 are cross-sectional views of the various embodiments of the non-planar interface, shown in FIGS. 2 and 3, formed between the substrate and the cutting table of a cutter.

FIGS. 2 and 3 are top views of two other non-planar interfaces. The interface shown in FIG. 2 is formed by a set of parallel wiggly irregularities 36 formed on the face of the substrate. The interface shown in FIG. 3 is formed by a set concentric irregularities 38. Each of the concentric irregularities of FIG. 3 forms a square having rounded corners. In a first embodiment, these irregularities of FIGS. 2 and 3 are grooves in the substrate. These grooves have concave cross-sections 40 (FIG. 14). Their depth 42 is preferably at least 0.005 inch and typically not more than 0.03 inch.

Figure 15:
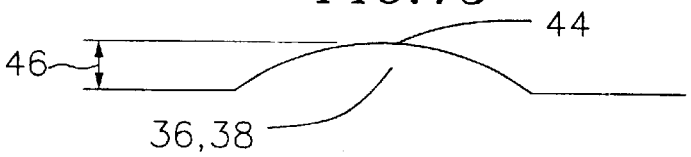

In a second embodiment of the interfaces shown in FIGS. 2 and 3, the irregularities are ridges 44 which are the mirror images of the grooves of the first embodiment (FIG. 15). In other words, these ridges have a convex cross-section. Their height 46 is preferably at least 0.005 inch and typically not more than 0.03 inch.

Figure 16:
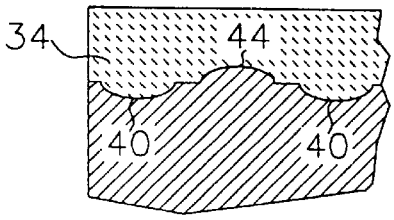

In a third embodiment of the interfaces shown in FIGS. 2 and 3, the irregularities on the substrate can be a combination of both the grooves of the first embodiment and the ridges of the second embodiment (FIG. 16).

Figure 17:
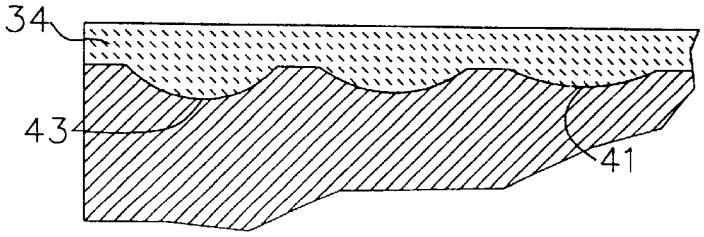

In a fourth embodiment of the interfaces shown in FIGS. 2 and 3, the irregularities are grooves with increasing depth toward the circumference of the cutter such that the grooves 41 near the center of the substrate are shallower while the grooves 43 near the circumference of the substrate are deeper (FIG. 17). This embodiment provides for more diamond volume at the high impact area of the cutting table.

Figure 18:
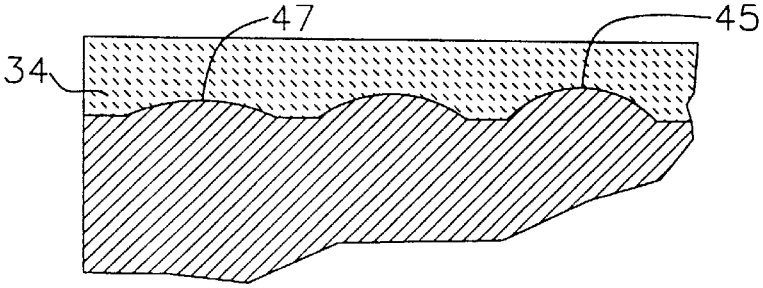

In a fifth embodiment, the irregularities are ridges with decreasing height toward the circumference of the cutter such that the ridges 45 near the center are higher than the ridges 47 near the cutter circumferential edge (FIG. 18). In this regard, the diamond volume differential will increase from the center of the diamond toward the diamond circumference which is the area of the cutting table most often used for cutting.

Figure 19:
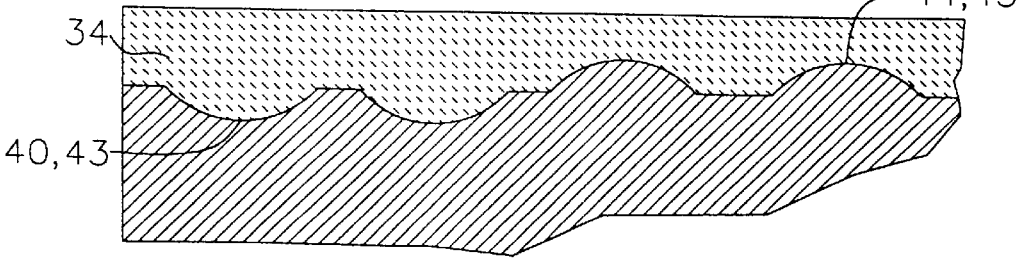

In a sixth embodiment of the interfaces shown in FIGS. 2 and 3, the irregularities near the center are ridges 44, 45, while the irregularities near the circumferential edges of the cutting elements are grooves 40, 43 (FIG. 19). This embodiment provides for an increase in the volume differential of the diamond in a direction away from the center of the cutter.

Figure 4:
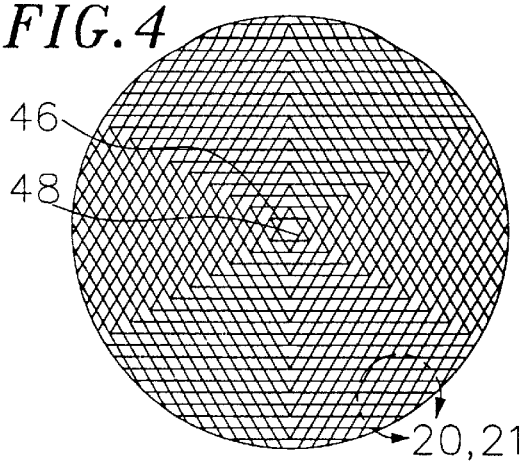
Figure 5:
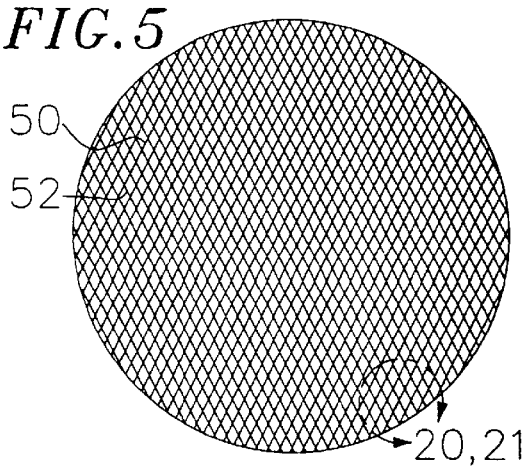

FIGS. 4 and 5 depict two other non-planar interfaces which are the subject matter of this invention. The interface shown in FIG. 4 is formed by two sets of grooves. The first set of grooves 46 defines a set of concentric triangles. The second set of grooves 48 defines a second set of concentric triangles which is superimposed on the first set of concentric triangles. The triangles within each set of concentric triangles are equally spaced. Each set of concentric triangles includes portions of triangles which cannot be fully included in the set because of the geometry of the substrate interfacing surface. For example, it can be seen that on the cylindrical interfacing surface of the substrate shown in FIG. 4 only portions of the larger triangles near the circumference of the substrate are included. The first set of triangles is oriented opposite the second, such that when the two sets are superimposed they form a set of concentric six-point stars and portions thereof.

The interface shown in FIG. 5 is formed by two sets of linear parallel grooves. The first set of grooves 50 intersects the second set of grooves 52.

The grooves of the interfaces shown in FIGS. 4 and 5 have a depth that is preferably at least 0.005 inch and typically not more than 0.03 inch.

Figure 20:
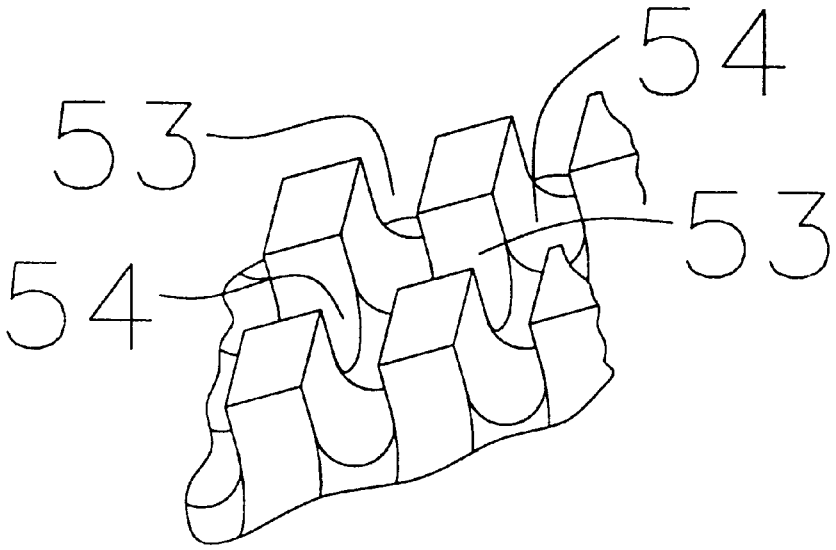
FIGS. 20 and 21 are isometric views of two embodiments of the non-planar interface, shown in FIGS. 4 and 5, formed between the substrate and the cutting table of a cutter.

In a first embodiment of the interfaces shown in FIGS. 4 and 5, the grooves 53 have bottom with concave cross-sections 54 (FIG. 20).

Figure 21:
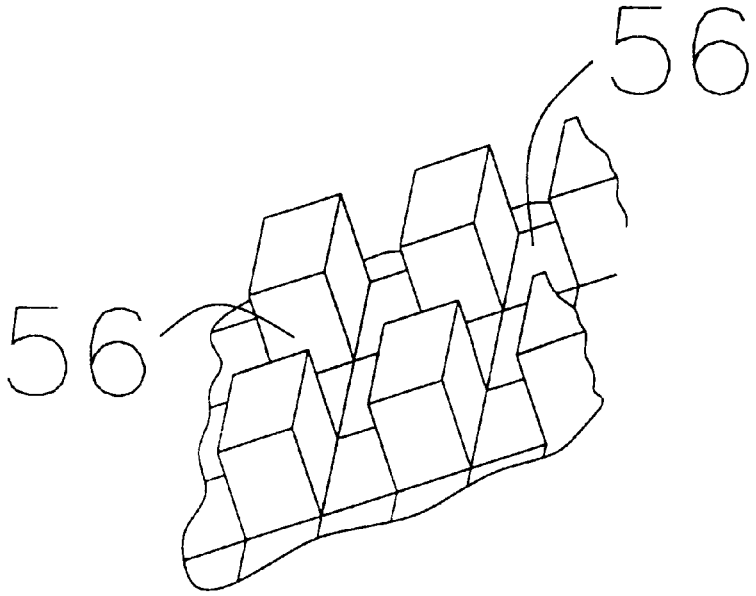

In a third embodiment of the interfaces shown in FIGS. 4 and 5, the grooves have a square bottom 56 (FIG. 21).

In a fourth embodiment of the interfaces shown in FIGS. 4 and 5, the grooves have a depth which increases toward the edges of the cutter such that the grooves are shallower at the center of the substrate and deeper near the circumference of the substrate. In this regard, the diamond volume differential will increase from the center of the diamond toward the diamond circumference.

Figure 6:
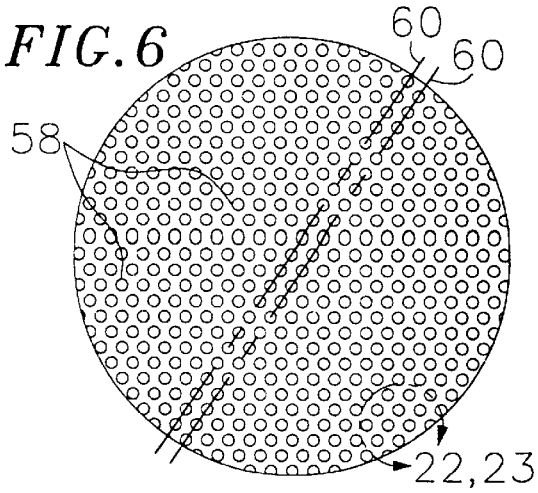
Figure 22:
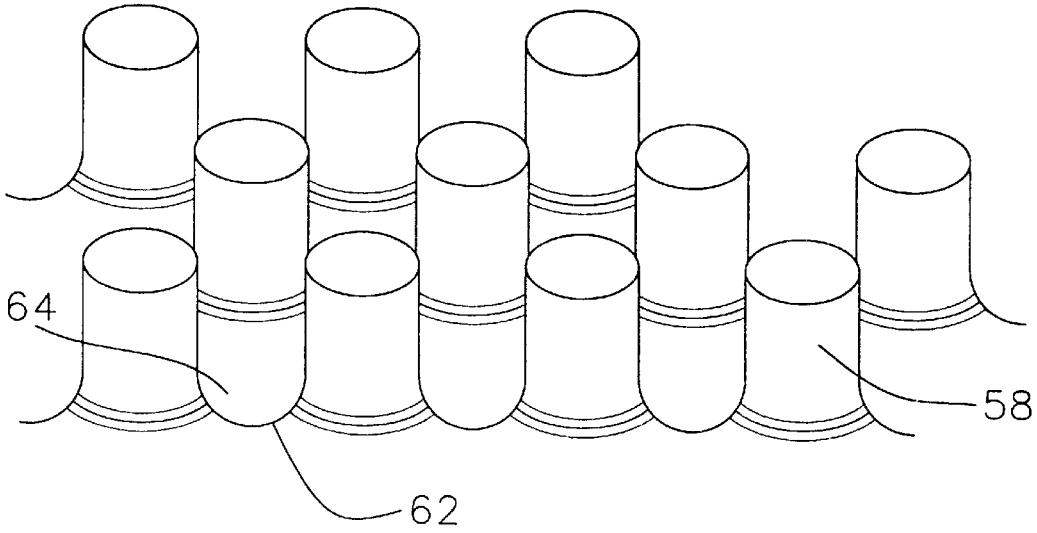
FIGS. 22 and 23 are isometric views of two embodiments of the non-planar interface, shown in FIG. 6, formed between the substrate and the cutting table of a cutter.
Figure 23:
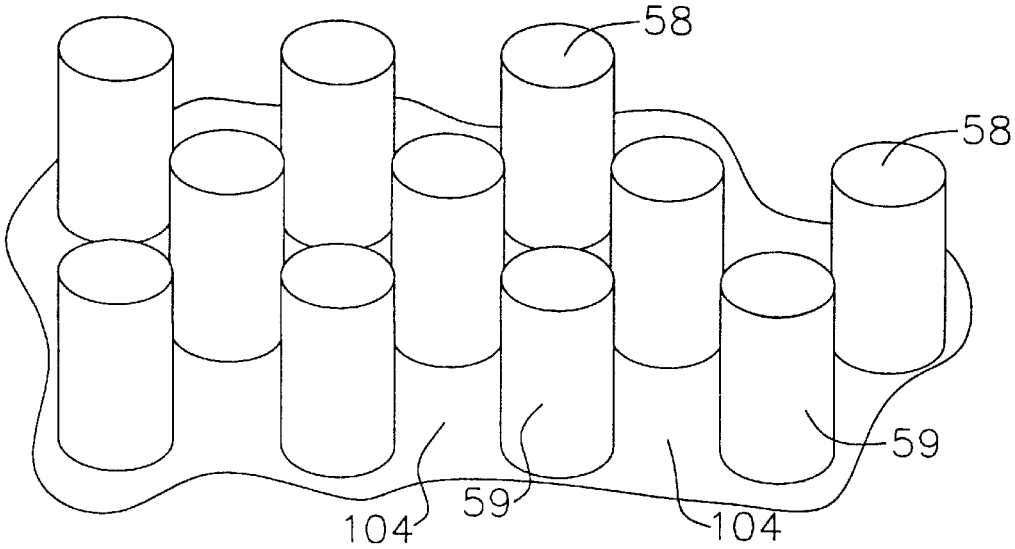

The interface shown in FIG. 6 has cylindrical protrusions 58 (FIG. 22). These protrusions are oriented along parallel lines 60 (FIG. 6). In a first embodiment of the interface shown in FIG. 6, the bases of the protrusions flare out forming a concave surface 62 between adjacent protrusions. These concave surfaces form bowled depressions 64 between any three adjacent protrusions, i.e., between any three protrusions where each protrusion is adjacent to the two other protrusions. In a second embodiment, the cylindrical protrusion sidewalls 59 are perpendicular to the substrate surface 104 (FIG. 23). The protrusions have a height measured from the lowest point on the substrate surface on which they are formed that is preferably at least 0.005 inch and typically not more than 0.03 inch.

In a fifth embodiment of the interface shown in FIG. 6, the protrusions have heights which decrease toward the edges of the cutter such that the protrusions are higher at the center of the substrate and deeper at the circumferential edges of the substrate. In this regard, the diamond volume differential will increase from the center of the diamond toward the diamond circumference.

Figure 24A:
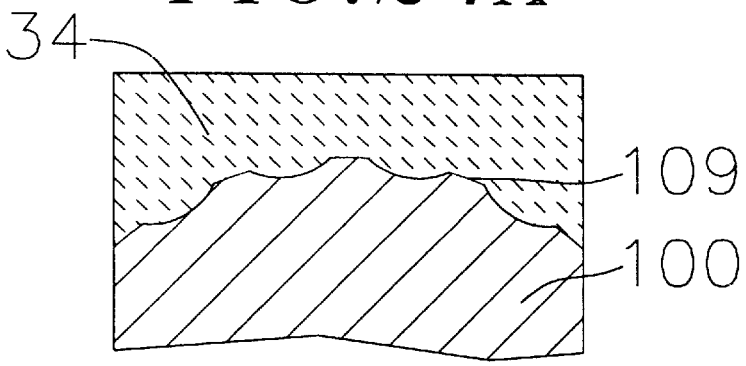
FIG. 24A is a cross-sectional view of part of a cutter having a substrate with a convex (dome shaped) surface, on which are formed depressions, interfacing with a cutting table.

Any embodiment of any of the aforementioned interfaces may be formed on a convex (i.e., dome-shaped) substrate surface 109 (FIG. 24A). This embodiment allows for more diamond on the cutting table near its circumference which is the portion of the cutter that will be subject to the higher impact loads.

Figure 24B:
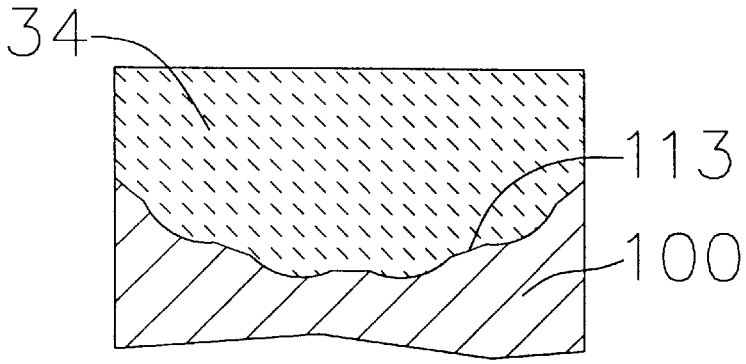
FIG. 24B is a cross-sectional view of part of a cutter having a substrate with a concave surface, on which are formed depressions, interfacing with a cutting table.

In another embodiment, any embodiment of any of the aforementioned interfaces may be formed on a concave substrate surface 113 (FIG. 24B).

Figure 25:
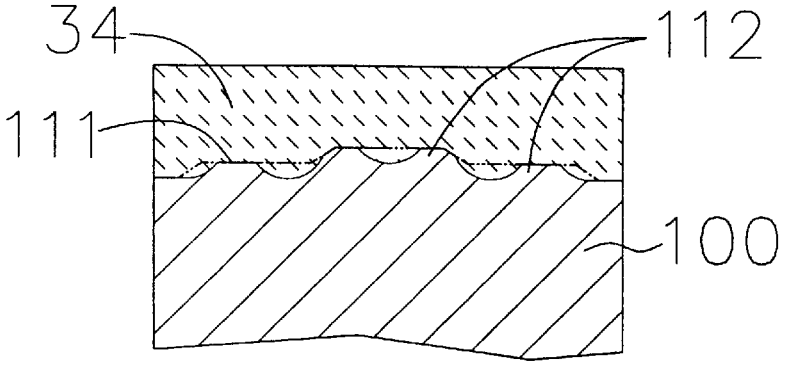
FIG. 25 depicts a cross-sectional view of part of a cutter having a substrate with a tiered shaped surface, on which are formed depressions, interfacing with a cutting table.

In a yet a further embodiment, any embodiment of any of the aforementioned interfaces may be formed on a tiered substrate surface 111 (FIG. 25). FIG. 25 shows an embodiment where depressions are formed on the tiered substrate surface. The tiered surface is formed by multiple conical sections 112 of decreasing diameter concentrically located one on top of the other. Preferably two tiers are used. Again, this embodiment allows for more diamond in the cutting table near the cutter circumference.

Figure 26:
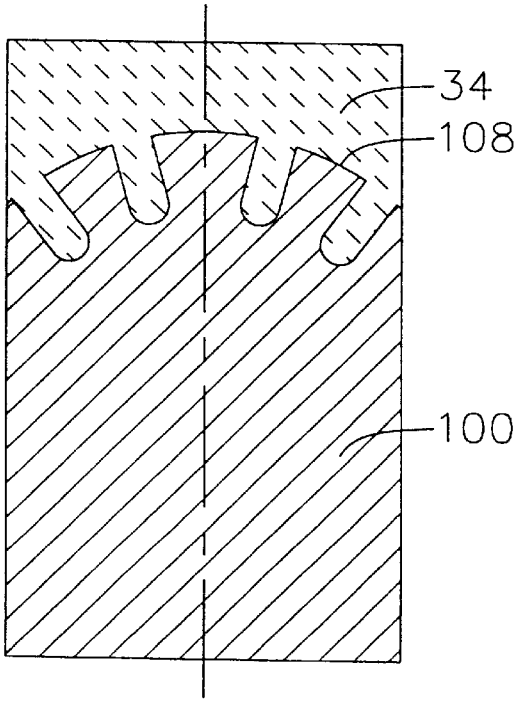
FIG. 26 is a cross-sectional view of a cutter having a convex interface on which are formed depressions perpendicular to the convex interface.
Figure 27:
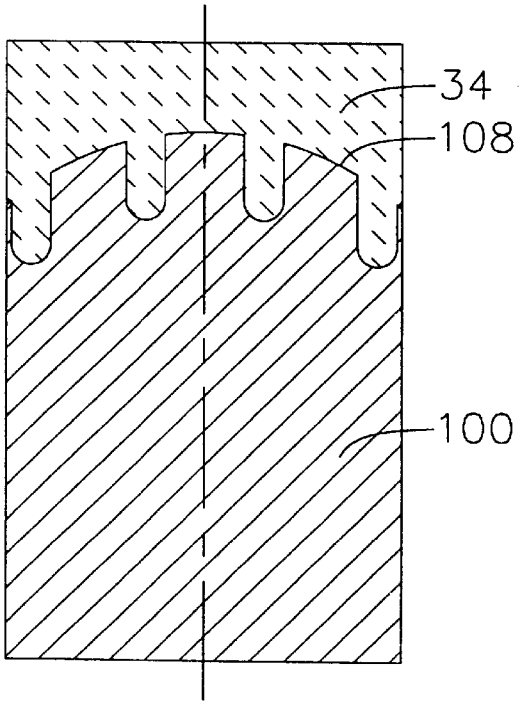
FIG. 27 is a cross-sectional view of a cutter having a convex interface on which are formed longitudinal depressions.
Figure 28:
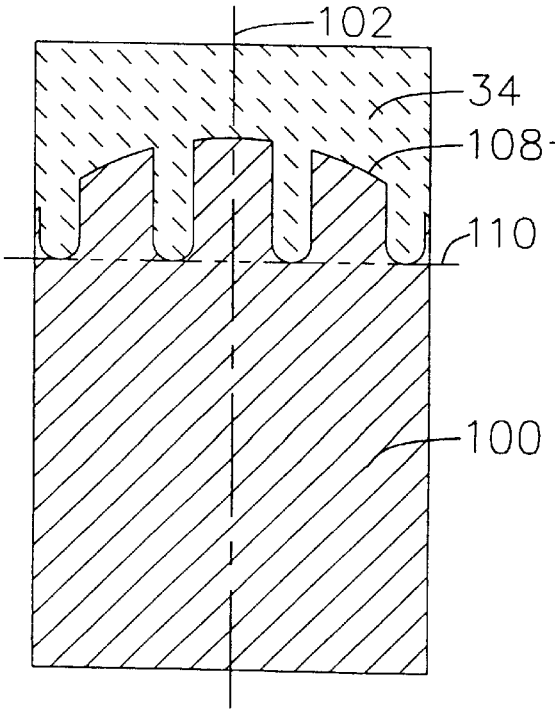
FIG. 28 is a cross-sectional view of a cutter having a convex interface on which are formed depressions all of which extend to the same plane (i.e., level) which is perpendicular to the cutter's longitudinal axis.
Figure 29:
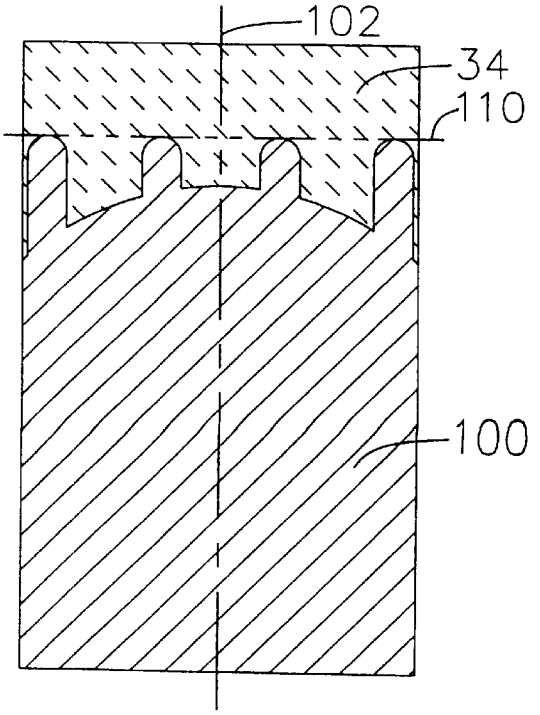
FIG. 29 is a cross-sectional view of a cutter having a convex non-planar interface on which are formed protrusions all of which extend to the same horizontal plane (i.e., level) which is perpendicular to the cutter's longitudinal axis.
Figure 30:
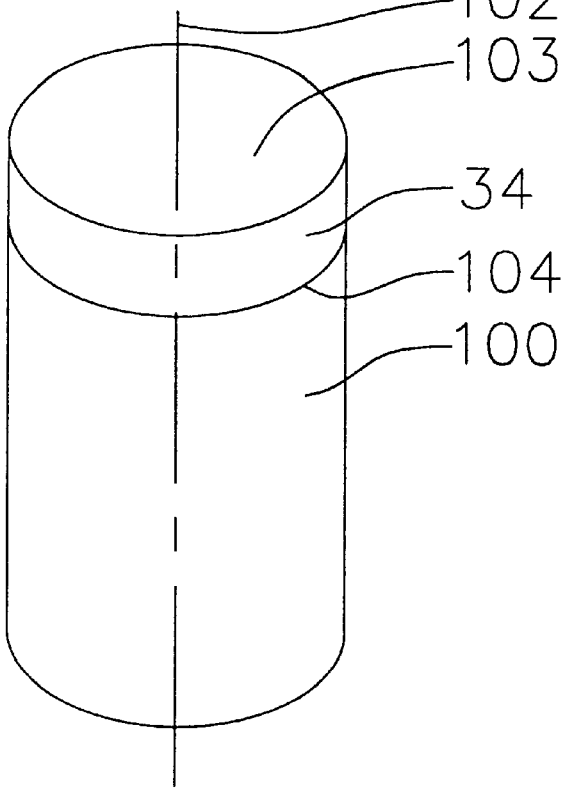
FIG. 30 is a side view of a cutter.
Figure 31:
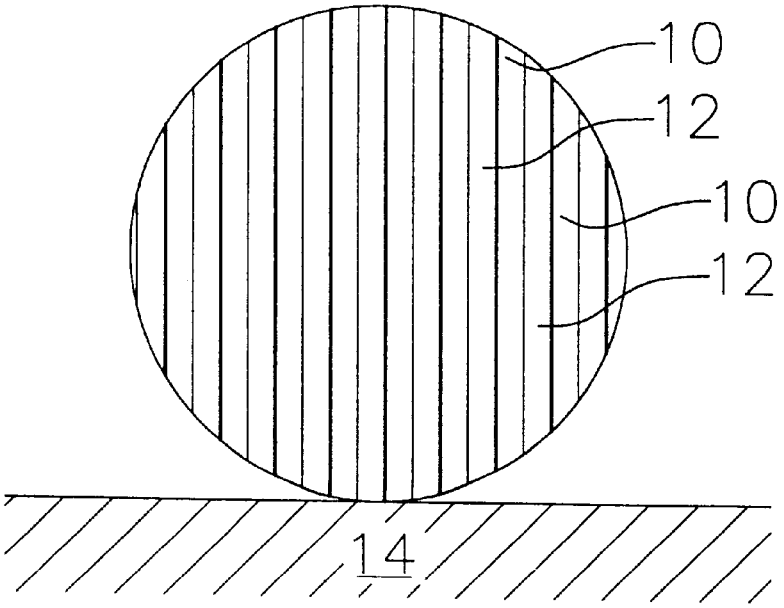
FIG. 31 PRIOR ART
FIG. 31 depicts the orientation of parallel grooves and ridges of a prior art non-planar interface in relation to an earthen formation.

Moreover, for any of the aforementioned interfaces formed on a convex, concave or tiered substrate, the depressions or protrusions may be project perpendicularly to the substrate interfacing surface (FIG. 26) or longitudinally along the substrate (FIG. 27) on which they are formed. Furthermore, with any of the aforementioned interface embodiments all the depression bottoms may be tangent to a single horizontal plane 110 i.e., a plane perpendicular to the longitudinal axis 102 of the substrate (FIG. 28). Similarly, the upper surfaces of the protrusions may be tangential to a single horizontal plane (FIG. 29). In other words, all the protrusions/depressions extend to the same level (i.e., horizontal plane).

Although this invention has been described in certain specific embodiments, many additional modifications and variations will be apparent to those skilled in the art. It is therefore, understood that within the scope of the appended claims, this invention may be practiced otherwise than as specifically described.

We claim:

1. A cutting element comprising:

a substrate having an interface surface, the interface surface comprising a plurality of circular irregularities arranged to form concentric annular rows; and a hard material cutting layer having a first surface bonded to the substrate interface surface.

2. A cutting element as recited in claim 1 wherein the interface surface is tiered.

3. A cutting element as recited in claim 2 wherein the tiered interface surface comprises a plurality of conical sections of decreasing diameter situated concentrically one on top of the other and arranged in decreasing diameter order in a direction away from the base.

4. A cutting element as recited in claim 3 wherein each conical section comprises a larger diameter circumference opposite a smaller diameter circumference, wherein the smaller diameter circumference of each section is located further from the base than the larger diameter circumference of that section.

5. A cutting element as recited in claim 1 wherein the irregularities are concave dimples.

6. A cutting element as recited in claim 5 wherein at least two dimples have different depths.

7. A cutting element as recited in claim 1 wherein the irregularities are cylindrical depressions having a concave bottom.

8. A cutting element comprising:

a substrate having a base and a tiered interface surface opposite the base, the tiered interface surface forming a series of steps each step having a planar surface stepping toward the base in a radially outward direction, wherein each step has a depth relative to an adjacent step, wherein the depth of each consecutive step in a radially outward direction is not less than the depth of the radially inward adjacent step;

a plurality of irregularities formed on the tiered interface surface and surrounded at least in part by the planar surface of at least one of said steps; and a hard material cutting layer having a first surface bonded to the substrate tiered interface surface.

9. A cutting element as recited in claim 8 wherein the irregularities are dimples.

10. A cutting element as recited in claim 8 wherein the tiered interface surface comprises a plurality of conical sections of decreasing diameter situated concentrically one on top of the other and arranged in decreasing diameter order in a direction away from the base.

11. A cutting element as recited in claim 10 wherein each conical section comprises a larger diameter circumference opposite a smaller diameter circumference, wherein the smaller diameter circumference of each section is located further from the base than the larger diameter circumference of that section.

12. A cutting element comprising:

a substrate having a base and a tiered interface surface opposite the base, the tiered interface surface comprising a plurality of conical sections of decreasing diameter situated concentrically one on top of the other and arranged in decreasing diameter order in a direction away from the base;

a plurality of irregularities formed on the tiered interface surface; and a hard material cutting layer having a first surface bonded to the substrate tiered interface surface.

13. A cutting element as recited in claim 12 wherein each conical section comprises a larger diameter circumference opposite a smaller diameter circumference, wherein the smaller diameter circumference of each section is located further from the base than the larger diameter circumference of that section.

* * * * *